United States Patent [19]

Staffen

[11] 4,376,270

[45] Mar. 8, 1983

[54] CIRCUIT BREAKER

[75] Inventor: Martin Staffen, Barbing, Fed. Rep. of Germany

[73] Assignee: Siemens Aktiengesellschaft, Fed. Rep. of Germany

[21] Appl. No.: 298,652

[22] Filed: Sep. 2, 1981

[30] Foreign Application Priority Data

Sep. 15, 1980 [DE] Fed. Rep. of Germany ..... 3034790

[51] Int. Cl.[3] ..... H01H 73/02; H01H 75/00; H01H 77/00

[52] U.S. Cl. ..... 335/21; 335/24; 335/35; 337/70

[58] Field of Search ..... 335/21, 167, 35, 172, 335/24, 26; 337/70, 112, 72, 74

[56] References Cited

U.S. PATENT DOCUMENTS

| | | | |
|---|---|---|---|
| 2,190,517 | 2/1940 | Jennings | 337/112 |
| 2,779,840 | 1/1957 | Getchell | 337/70 |
| 3,512,112 | 5/1970 | Kick et al. | 337/70 |
| 4,032,875 | 6/1977 | Belttary | 337/70 |

*Primary Examiner*—Harold Broome

*Attorney, Agent, or Firm*—Scully, Scott, Murphy & Presser

[57] ABSTRACT

A circuit breaker having a switch mechanism consisting basically of a pivotally mounted latch which is releasably mounted on a release member and which carries a pivotally mounted contact, and of a pivotally mounted manually operable element for operating the circuit breaker. A spring is connected to the manually operable element at a position offset with respect to the pivotal axis of the element and is arranged to apply a force to the pivotable latch at a position close to the pivotal axis of the latch. A latch lever interconnects the manually operable element and the pivotable latch and is connected to the manually operable element eccentrically with respect to the pivotal axis of the latter and is connected to the pivotable latch in a manner as to form the pivotal axis of the latter. A guide is arranged to guide the movement of the latch lever caused by operation of the manually operable element, and the spring is arranged to apply a force to the pivotable latch indirectly by engaging with the pivotally mounted contact carried by the latch.

5 Claims, 3 Drawing Figures

CIRCUIT BREAKER

BACKGROUND OF THE INVENTION

1. Field of the Invention

The present invention relates to a circuit breaker which has a switch locking mechanism including a rotatably supported latch which is releasably mounted on a release member and which carries a pivotally mounted contact lever, and a manually operable element for operating the circuit breaker, which is connected with a spring at a location offset with respect to the pivotal axis of the element and is connected with the latch at a location proximate the pivotal axis thereof.

2. Discussion of the Prior Art

A circuit breaker of the above-mentioned type is known from U.S. Pat. No. 2,190,517, and incorporates a switch locking mechanism having only a few components, particularly in the construction of a switch locking mechanism in the form of a so-called "switch locking cam". However, the construction thereof requires a pressure spring for the manual actuation of the pivotable contact and the manually operable element, as well as a further spring which opens the contact lever when the latch is released.

In order to again switch in the known circuit breaker this latter must, after a trip-free release, be manually switched back into the switch-off position and then again into the switch-on position. The theoretically required springs, one for switch movement, one for contact pressure and one for manual resetting and relatching are consequently reduced by only one spring.

The present invention is thus based on the recognition that the known circuit breaker can be improved so as to render it more responsive to present demands, by providing a circuit breaker which, through the utilization of a continuously operating switch locking mechanism, such as a switch locking cam, in essence in the absence of a quick-break switch mechanism, only requires a single spring.

SUMMARY OF THE INVENTION

Accordingly, it is an object of the invention to provide a circuit breaker which incorporates a switch locking mechanism or locking cam comprising a pivotable latch which is releasably mounted on a release member and which carries a pivotally mounted contact, a pivotally mounted manually operable element for operating the circuit breaker, and a spring connected to the manually operable element at a position offset with respect to the pivotal axis of the element and arranged to apply a force to the pivotable latch at a position close to the pivotal axis of the latch. A lever interconnects the manually operable element and the pivotable latch, with the lever being connected to the manually operable element eccentrically with respect to the pivotal axis of the latter, and being connected to said pivotable latch in a manner so as to form the pivotal axis of latch. A guide is provided for guiding the movement of the lever effected by operation of the manually operable element, and in which the spring is arranged so as to indirectly apply a force to the pivotable latch by engaging with the piovtally mounted contact carried by the latch.

The spring acting between the manually operable element and the latch is therefore not connected directly to the latch but indirectly through intermediary of the pivotally mounted contact lever carried by the latch. A circuit breaker of this type with a continuously operating switch locking mechanism or "switch locking cam" provides the advantage that relay chatters on the contacts are extensively avoided. It is sufficient to have a single spring which renders possible the necessary switch movement and contact pressure, manual resetting and relatching.

Advantageously, when the spring is constructed as a tension spring, it engages the contact lever intermediate its axis of rotation and the pivotal axis of the latching lever, and wherein a rigid contact element associated with a contact element of the contact lever is disposed on the side towards the latch which is remote from the manually operable element. Such a circuit breaker evidences a particularly simple contruction.

The manual resetting after a trip-free release is achieved in a simple manner when the manually operable element forms a guide lip for the spring which in the trip-free release position of its imaginary centerline up to about a connecting line between the latching lever and the latch, on the one hand, and the pivotal axis of the manually operable element, on the other hand.

A particularly simple construction is obtained when the manually operable element is constructed with a roller shape and the latch lies on a magnetic rail as is known per se. In this manner the construction is rendered even simpler.

BRIEF DESCRIPTION OF THE DRAWINGS

A preferred embodiment of circuit breaker according to the invention is now described in detail hereinbelow, having reference to the accompanying drawings; in which.

DETAILED DESCRIPTION

Figure 1:
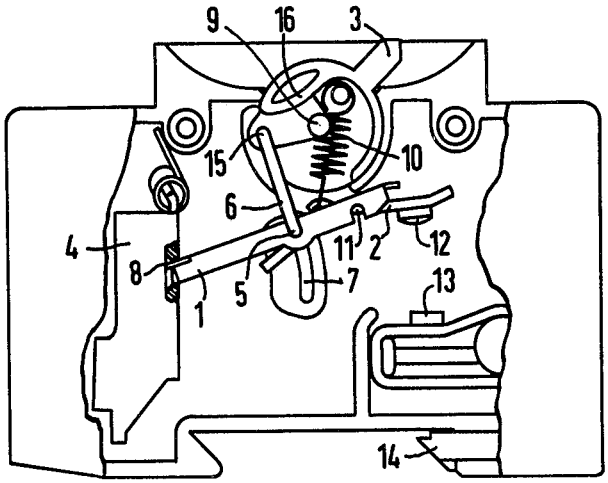
FIG. 1 illustrates a partly broken-away view of the inventive circuit breaker in the switch-off position.

The circuit breaker of FIG. 1 includes a switch locking mechanism or "switch locking cam", with a pivotally mounted latch 1, a contact lever 2 pivotally carried by the latch 1 and a manually operable element 3. The latch is releasably retained by a release member 4. In the illustrated embodiment the latter is a magnetic rail, in essence, a combined thermal and magnetic release mechanism, as is known, for example, from U.S. Pat. No. 3,081,368 or French patent specification No. 1 309 280. A latch lever 6 interconnects the latch 1 and element 3 and forms the pivotal axis 5 of the latch 1; the lever being guided within a guide 7 so that there is produced a generally constant distance to the latching location 8 of mechanism 4 in which there is retained the latch 1. The latch lever 6 is connected eccentrically to the manually operable element 3 with respect to the pivotal axis 9 thereof. A spring 10, in the embodiment shows a tension spring, that connects with element 3 at a position offset with respect to the pivotal axis of the element and is adapted to apply a force to the pivotable latch 1 at a position close to the pivotal axis 5 of the latch. Thus, the spring 10 engages the latch indirectly in that it engages the contact lever 2 which is overlapped partially in a U-shaped manner by the latch 1 and which is pivotally retained by the latch at 11.

Disposed on the contact lever 2 is a contact element 12, and arranged on an associated fixed contact of the circuit breaker is a contact element 13. Quenching plates can be disposed between the contact elements in known manner, which, however, are not necessary for simple switching tasks. The current path through the release mechanism 4, which may also be a conventional electromagnetic and thermal release mechanism, can extend to the contact lever 2 through a stranded cable of known type (not shown), and from there to the contact element 13 and a connecting terminal. A further connecting terminal can be arranged on the other side of the circuit breaker at the release mechanism 4. The circuit breaker can be snapped onto carrier rails by means of a locking device 14 in a conventional manner.

When the spring 10, upon construction thereof as a tension spring, engages on the contact lever 2 between its axis of rotation 11 and the pivotal axis 5 of the latching lever 6, it is advantageous that the fixed contact element 13 associated with the contact element 12 of the contact lever 2 be disposed on the side of the latch 1 remote from the manually operable element 3. A construction of this type is shown in FIG. 1. In the exemplary embodiment, the latching lever 6 is rotatably connected to the manually operable element 3.

Figure 2:
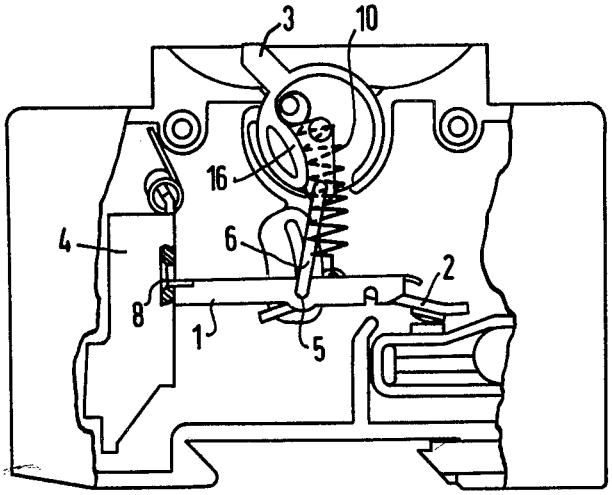
FIG. 2 illustrates a view similar to FIG. 1 showing the circuit breaker in its switch-on position.
Figure 3:
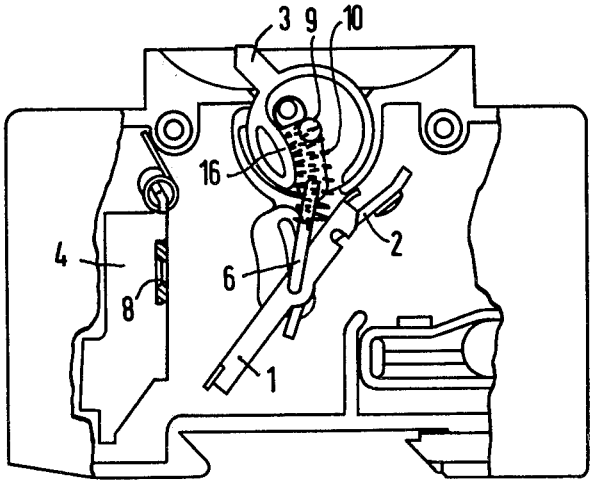
FIG. 3 shows the circuit breaker during trip-free release, when a manually operable element has been held fixed, therefore during operation of the circuit breaker; when the manually operable element is released, it is conveyed into the position shown in FIG. 1, wherein it shows the switch-off position.

When the circuit breaker is conducted into its switch-on position, the switch condition of FIG. 1 moves into that shown in FIG. 2. According to a further feature, the manually operable element 3 forms a guide lip 16 for the spring 10. The guide lip is engaged by the spring, so that in the trip-free release position of the circuit breaker, when the manually operable element 3 is held in the hand, the circuit breaker will respond to cause release of the pivotable latch 1 by the release member 4, so that the imaginary center line of the spring 10 will lift, on the one hand, about substantially up to a line; extending from the latching lever 6 to the latch 1 and, on the other hand, the pivotal axis 9 of the manually operable element 3. The switch position of the trip-free release is illustrated in FIG. 3. In this switch position, the spring 10 can contact considerably and an unstable condition results with respect to the torque cause by the tensile force of the spring 10 so that the internal spring forces which tend to produce a linear position cause an assumption of the position of FIG. 1 after release of the manually operable element 1.

In the exemplary embodiment, the manually operable element 3 is constructed in a roller shape as is illustrated in the Figures. For resetting from trip-free release according to FIG. 3 into the switch-on position, after the manually operable element has been released, the latter only needs to be brought from the switch-off position into the switch-on position. After trip-free release according to FIG. 3, when the manually operable element 3 has moved towards the right in a clockwise direction, the latching lever 6 raises the latch 1 to the latching location 8 under the pulling force of the spring 10. During this sequence, the position of the latching lever 6 and the imaginary axis of the spring 10 will increasingly diverge until they have reached the position shown in FIG. 1. Thereby, the torque exerted by the spring 10 becomes increasingly greater so as to achieve an increasing relatching force.

What is claim is:

1. In a circuit breaker having a switch locking mechanism including a pivotable latch releasably mounted on a release member and which supports a pivotally mounted contact; a pivotally mounted manually operable element for operating the circuit breaker; and a spring connected with said manually operable element at a position offset with respect to the pivotal axis of the element and adapted to exert a force on said pivotable latch at a position proximate the pivotal axis of the latch, the improvement comprising:

a latching lever interconnecting the manually operable element and the pivotable latch, said lever being eccentrically connected with the manually operable element with respect to the pivotal axis of said element and being connected to said pivotable latch so as to form the pivotal axis of the latch;

a guide for guiding the movement of said latch lever responsive to operation of the manually operable element, said spring indirectly applying a force to said pivotable latch by engaging with said pivotally mounted contact supported by the latch.

2. A circuit breaker as claimed in claim 1, wherein said spring is a tension spring and engages the pivotally mounted contact intermediate its pivotal axis and the pivotal axis of the latch formed by said lever; and a fixed contact element of the circuit breaker being associated with a contact element of the pivotally mounted contact on the side of the latch remote from the manually operable element.

3. A circuit breaker as claimed in claim 2, wherein the manually operable element comprises a guide engageable with said spring so as to, in a trip-free release position of the circuit breaker responsive to release of the pivotable latch by the release member, raises the imaginary center line of the spring substantially in conformance with a line connecting the latching lever to the latch and the pivotal axis of the manually operable element.

4. A circuit breaker as claimed in claim 1, wherein the manually operable element is constructed in a roller shape.

5. A circuit breaker as claimed in claim 1, wherein the pivotable latch is positioned on a magnetic rail.

* * * * *